United States Patent [19]

Currey, Jr.

[11] Patent Number: 4,913,443

[45] Date of Patent: Apr. 3, 1990

[54] BOARD GAME OF TAG

[76] Inventor: Gene G. Currey, Jr., 982 E. Lassen Ave. #39, Chico, Calif. 95926

[21] Appl. No.: 255,858

[22] Filed: Oct. 11, 1988

[51] Int. Cl.[4] ..... A63F 3/00

[52] U.S. Cl. ..... 273/244; D21/24; 273/243; 273/260

[58] Field of Search ..... 273/243, 271, 260, 261, 273/262; D21/24

[56] References Cited

U.S. PATENT DOCUMENTS

| | | | |
|---|---|---|---|
| 16,341 | 11/1887 | Wakely | 273/264 |
| D. 122,901 | 10/1940 | Marvin | D21/24 |
| 2,212,846 | 8/1940 | Pilla | 273/243 |
| 2,745,667 | 5/1956 | Graham et al. | 273/243 |

*Primary Examiner*—Edward M. Coven
*Assistant Examiner*—Benjamin Layno

[57] ABSTRACT

The invention provides a foldable game board with colored squares on a playing surface. Each square is colored with one of nine different colors. The game board is arranged for play by two to four players each having a home strip. The home strip has numbered scoring squares along all four sides of the playing surface. Four sets of two player's marker and a deck of nine colored cards are supplied to each player. Each card of a deck is distinguishably colored with one of the nine different colors corresponding to the colored squares. Movement of the markers to particularly colored squares are determined by the color of cards drawn from decks of nine cards. Movement of the playing pieces is omnidirectional and the object of the game is that an "it" player tries to tag the other players by moving into a square adjacent to one occupied by another player.

1 Claim, 6 Drawing Sheets

BOARD GAME OF TAG

BACKGROUND OF THE INVENTION

1. Field of the Invention

This invention relates to board games. The present invention is particularly directed towards games played on a foldable board using a designed player movement surface, moveable markers, and drawing cards designating moves. Players using the "tag" game constituting the present invention will use uniquely colored movement patterns on the board playing surface combined with matching cards to be drawn as movement indicators and individually colored home score positions with matching movement markers. The game is unique in that markers are moveable omnidirectional.

2. Description of the Prior Art

Issued patents considered in the development of past art pertaining to the present invention were examined in the following classes and subclasses: 273/281, 241, 243.

Those patents deemed most pertinent included the following:

Regnard, (French) 330,088, Mar. 9, 1903 and the following USA patents:

Davis, 2,232,055, Feb. 18, 1941;
Hare et al, 2,453,907, Nov. 16, 1948;
Mossman, 3,455,556, July 15, 1969;
Moore, 3,642,286, Feb. 15, 1972;
Ladd, 3,948,524, Apr. 6, 1976; and
Bhatti, 4,385,764, Mar. 31, 1983.

As far as I can ascertain the foregoing patents illustrated games most pertinent to my invention. None of the disclosures described or illustrated a "tag" game similar in nature to my invention.

SUMMARY OF THE INVENTION

In practicing my invention, I provide a foldable game board with colored squares on a playing surface. The game board is arranged for four players and a home strip with numbered scoring squares edges all four sides of the playing surface. Four sets of cards matching colors on the playing surface are drawn and movement of each player's marker is indicated in the instruction with the game. Each player has two markers, one for scoring and one for movement on the board. The markers are individually colored to match the player's scoring strip. Movement of the playing pieces is omnidirectional and the object of the game is that an "it" player trys to tag the other players by moving into a square occupied by the player.

Therefore, it is a primary object of my invention to provide a foldable gaming board having colored movement squares arranged on a game-playing surface useful for up to four persons on which to play a unique game of tag.

Another object of the invention is to provide a multi-squared gaming board useful for a game of tag with omnidirectional movement of playing markers.

A further object of my invention is to provide a tag game which can be played by up to four people using four decks of colored cards to draw and match to make moves.

A still further object of the present invention is to provide a board game with dual markers for the players, one marker for movement in play on the board playing surface and a second marker for each score keeping.

Other objects and the many advantages of the present invention will become obvious with a reading of the following specification and comparing numbered parts therein with similarly numbered parts shown on the included drawings.

DRAWING REFERENCE NUMERALS

Figure 1:
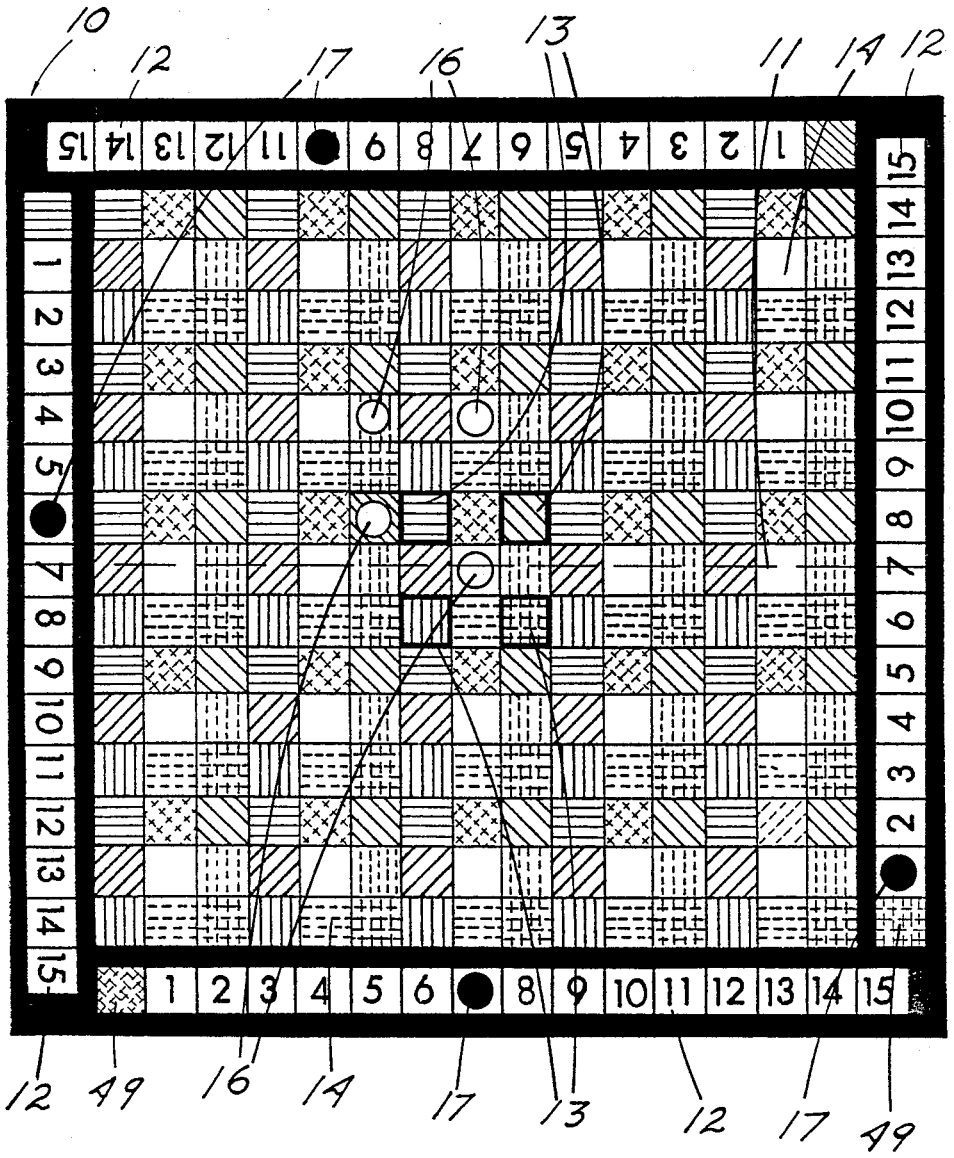
FIG. 1 shows the foldable game board of the present invention opened for use in a top plan.

10 play board
11 board fold
12 player scoring row (4)
13 position marker starting squares
14 colored move control squares
15 special playing cards
16 colored player's position marker
17 scoring markers
18 9-card multi-colored deck
20 marker matching colored card back
22 blue square move card
24 yellow square move card
26 brown square move card
28 orange square move card
30 green square move card
32 grey square move card
34 purple square move card
36 red square move card
38 white square move card
40 4 decks of colored cards
42 2 yellow markers
44 2 blue markers
46 2 red markers
48 2 green markers
49 2 starting square

DESCRIPTION OF THE PREFERRED EMBODIMENT

Figure 6:
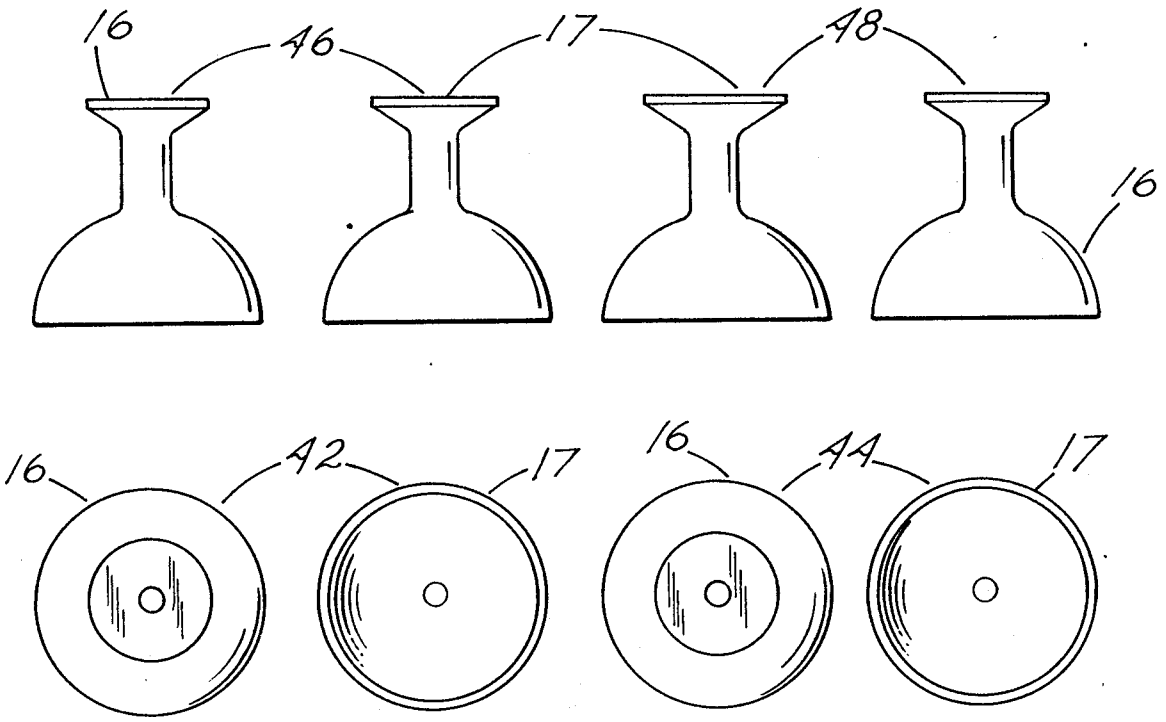
FIG. 6 shows four playing markers alternately turned in an end view and four scoring markers in a side view illustrating the two markers supplied each player.

Referring now to the drawings and to FIG. 1 where play board 10 is shown opened for play along board fold 11. The colored move control squares 14 on the game playing surface of play board 10 are illustrated in a top plan view. The four individually colored player scoring row 12 can be seen as a stripping along all four edges of play board 10. Position marker starting squares 13 are placed in a central location on the game marked surface of play board 10 as illustrated in the drawing and the individually colored scoring marker starting squares 49 are adjacent the numeral 1 on each player scoring row 12. The color of the scoring marker starting square is matched by the color of the scoring marker 17 used by the player in that particularly colored scoring marker starting square 49. Although a variety of color combinations may be applicable to this invention, the colors presently used for the matching score marker starting squares 49 and the score markers are yellow, blue, red, and green. The colored player's position marker 16 and the scoring marker 17 can be of similar shape and are of a matching color. The colored player's position marker 16 and the scoring marker 17 can be of similar shape and are of a matching color. The colored player's position marker 16 and the scoring marker 17 are illustrated at FIG. 6 in both end and side views. Two yellow colored markers 42 and two blue colored markers 44 illustrating position markers 16 in a top view and scoring markers 17 in a bottom view are seen in a bottom position on FIG. 6. In a side views of position markers 16 and scoring markers 17 on the top in FIG. 6, the first pair are colored red 46 and the second pair are colored green 48. When a player selects his playing position he plays with colored markers 16 and 17 which match the coloring at the scoring marker starting square 49 of the player scoring row 12. There are four to select from.

Figure 3:
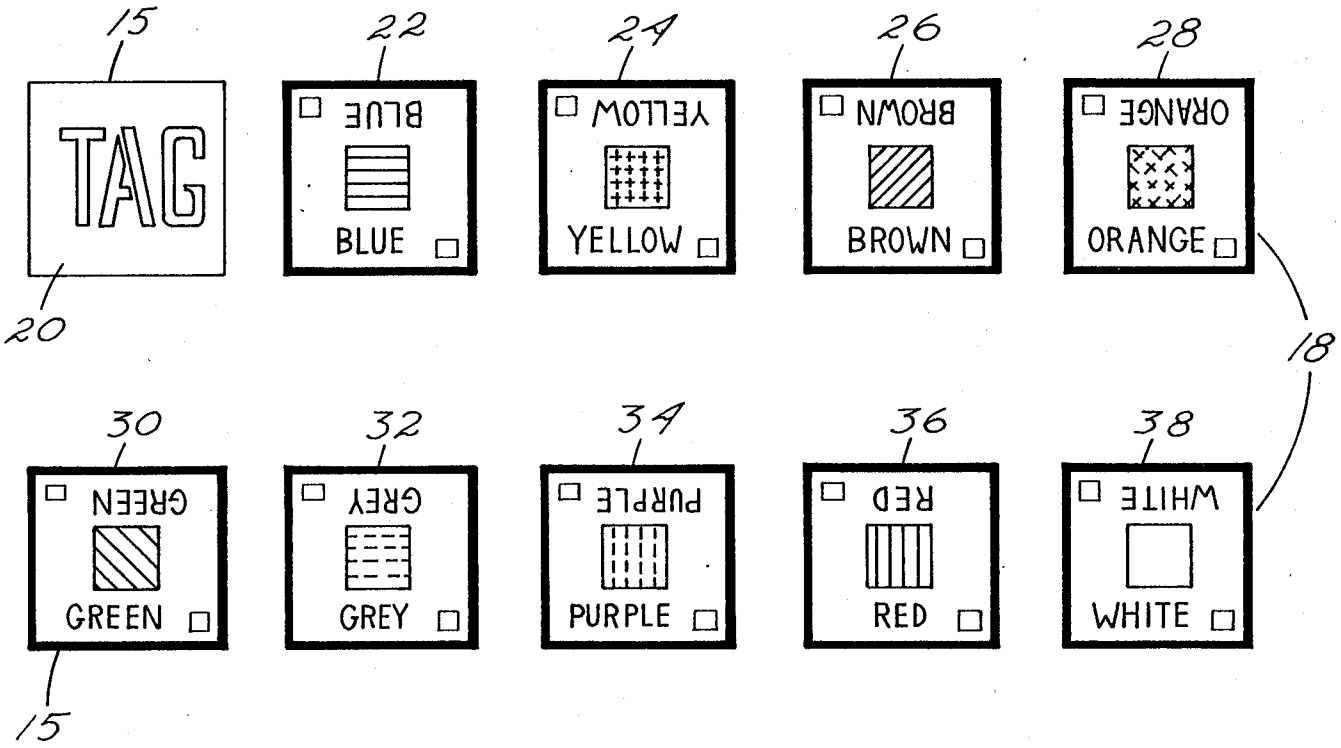
FIG. 3 shows one deck of the movement cards with the color sides visible on the nine cards used in each deck and an extra end card turned over to illustrate the back side of the cards.
Figure 4:
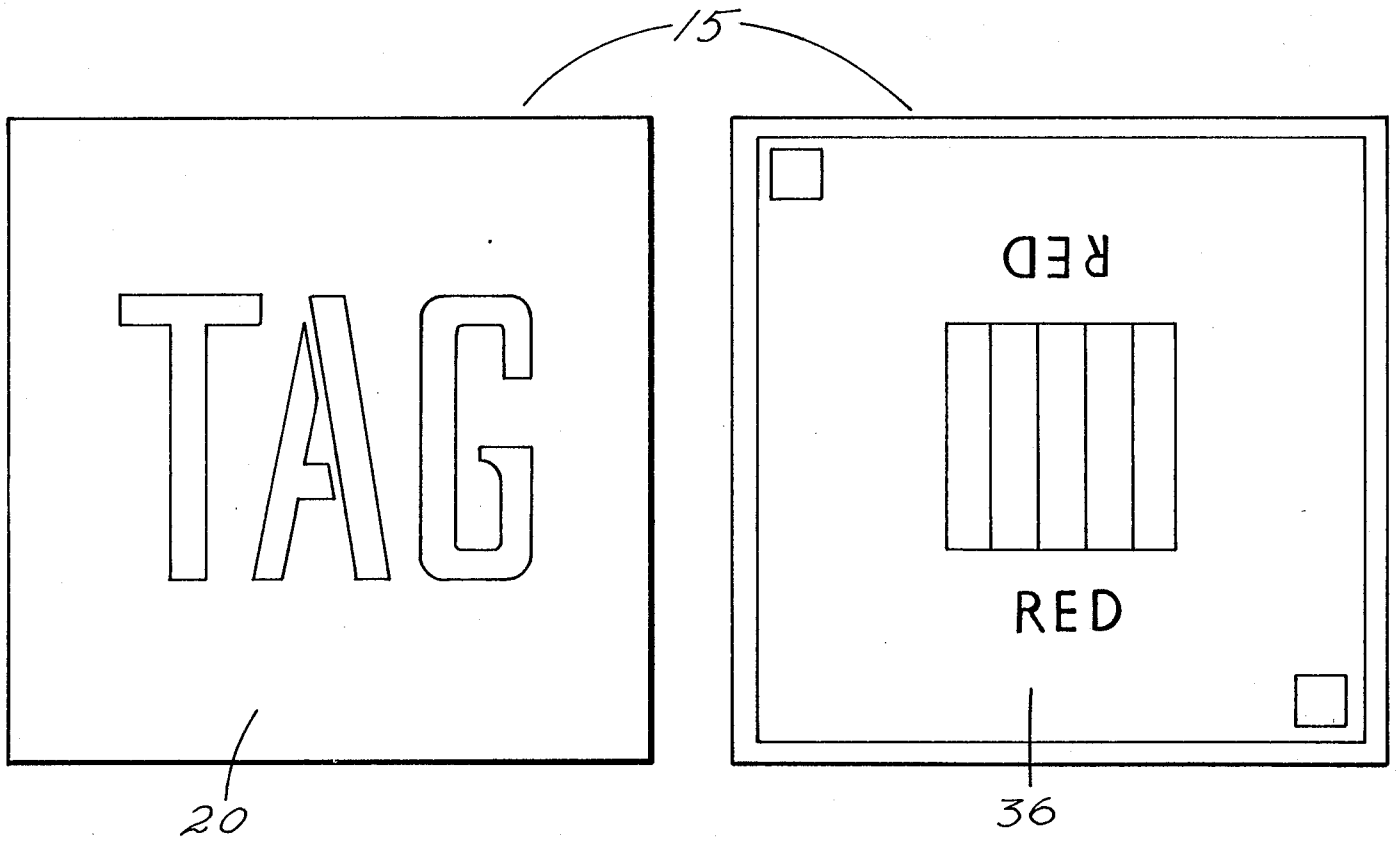
FIG. 4 is an illustration of a single card showing the colored playing side and the plain back side.

FIG. 3 and FIG. 4 illustrate the special playing cards 15 used to draw and match colors for movement of player's position markers 13 according to playing instructions later herein described. In FIG. 3, the first card in the left hand top row illustrates the special playing card 15 and the marker matching color card back which is the color assigned the individual player and matches the color of his markers 16 and 17 and of his scoring row 12 at the starting square 49. The other cards illustrated at FIG. 3 are turned to show the colors on the opposite side of the nine cards which constitues a single player's 9-card multi-colored deck 18. Those colors include blue square move card 22, yellow square move card 24, brown square move card 26, orange square move card 28, green square move card 30, grey square move card 32, purple square move card 34, red square move card 36; and white square move card 38. The colors on the move cards of special playing cards 15 indicate the color of the colored move control square 14 to which the marker 16 is moved. FIG. 4 better illustrates the front and the back of a single card of special playing cards 15. Marker matching colored card back 20 is shown at the left in the illustration and red square move card 36 is shown in the reversed illustration of special playing card 15.

Figure 5:
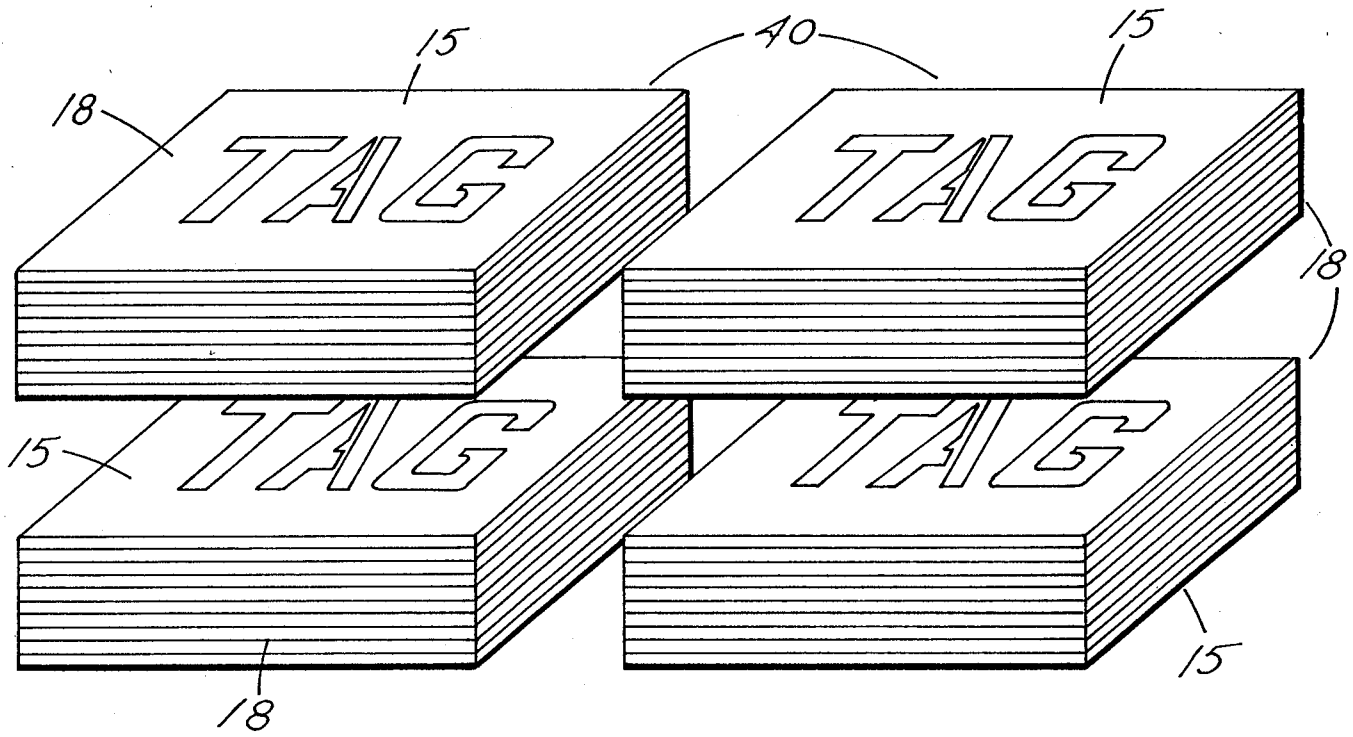
FIG. 5 shows the four sets of 9-card decks used as movement cards in the tag game of this invention.

FIG. 5 illustrates the four 9-card decks used as match-color draw cards in this game. The four decks of colored cards 40 are the player divisions of special playing cards 15 and the four decks are each made up of 9-card multi-colored decks 18. Each of the four players is assigned one deck the backs of which 20 match his colored player's position marker 16 and his scoring marker 17.

Figure 2:
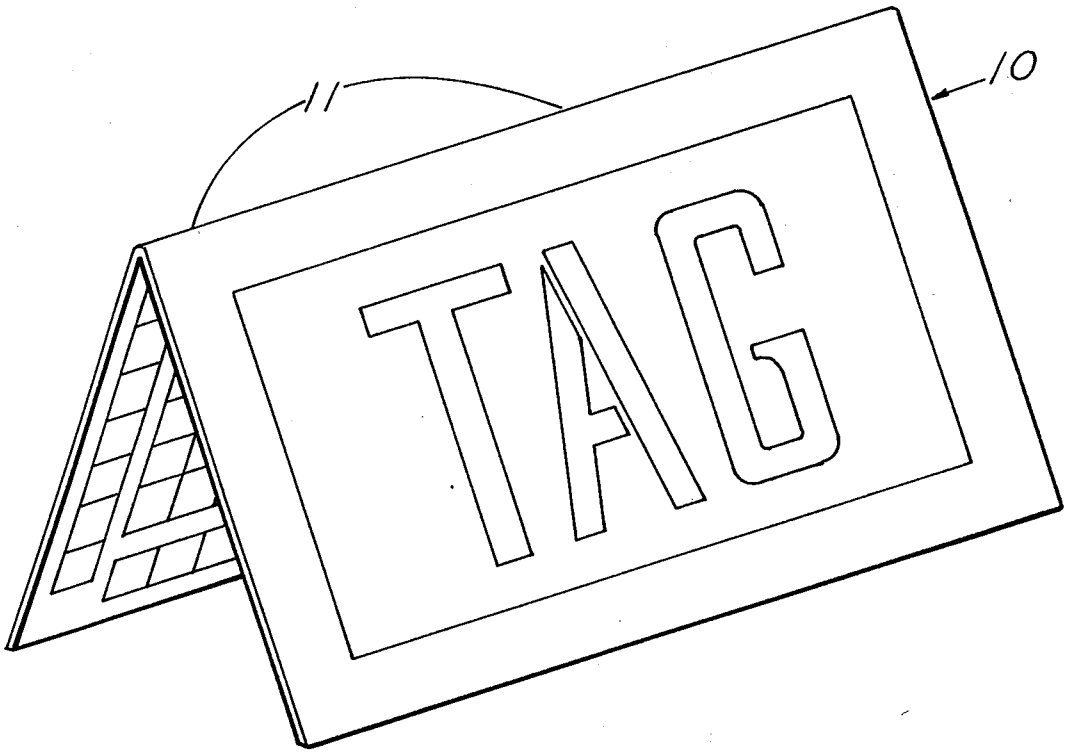
FIG. 2 shows my invention with the gaming board partly folded.

A description of the game constituting the present invention, the game parts and playing the game follows: A playing board is provided which can be centrally folded for storage or packaging as illustrated in FIG. 2 of the drawings. On the playing side of the opened board is a field of colored squares and a boarder squared and numbered on four sides for from two to four players to use as scoring strips. The scoring strip squares are marked 1 to 15 on a white base with a colored square on the end of each scoring strip. Each player is supplied with two individually colored markers. One is for moving along the scoring strip to keep track of the individual player's score. The other is for use in the center field of the board which has a multicplicity of colored squares extending from the scoring strip edges to cover the entire field of the game board surface. Centrally marked in the playing field squares, are four darkened colored squares which correspond to the colors of the player's markers. These darkened squares indicate starting position for each player. The end colored squares in the player's scoring strips also correspond to the color of the marker used by the player and to the starting square in the center of the field. I supply four decks of cards having nine cards in each deck. The backs of the cards in each deck is colored to match the player's marker. The front side of the card is marked with a colored square which corresponds to a colored square on the playing board field. Nine colors are used including blue, yellow, brown, orange, green, grey, purple, red, and white. The playing board field is divided into multiple squares using the basic colors in a nine-pattern group. The groups are repeated five time crosswise and five times lengthwise. Selection of of scoring strip to play on and color to play with is done by drawing a marker from a cup held so the drawer cannot see the markers. The player drawing the yellow marker starts the game as "it."

The game is designed to be a game of "tag" in which one player is "it" until by a strategy of moving his markers he is able to catch up with and land his marker on an adjacent square to the marker of another player at the end of a game turn. He has then "tagged" the other player, who in turn becomes "it." A game turn is determined by the selection of two cards by each player without showing the cards to the other players. The cards are turned over one at a time. The color exposed on the face of the card determines what color square the player is to move his marker to which he proceeds to do. The second card is then turned over and the players proceed to move their markers to the color square on the game board field as shown on the second card. If you are "it" and you match the color on another player's turned-over card, you get one free move for each color so matched to any adjacent colored square you choose. If several players turn up the same colored card which "it" matches, the "it" marker is limited to one free move for the colors matched. It is possible for the "it" player to make two matches in any game turn. If no colors are matched all players move their markers to adjacent colored squares on the playing field which match the colors shown on the face of the turned-over cards. Who ever is "it" at the end of a game turn (two cards), must move his scoring marker up one point per turn on his scoring strip numbers.

Three main methods are used for the restart of a game when "it" has been exchanged by a "tag."

The players may elect to start over by placing their markers in the center starting squares after each "tag." However, the player who is "it" at the end of a game turn must move his scoring marker along the scoring strip numbered 1 through 15. When one player's score reaches the 15-square he is considered to have lost the game. The second restart method is to require the person who has just been "tagged" and is now "it" to place his marker in the white square in the exact center of the playing field board. "It", then must start from there while the rest of the players may remain where they are. Scoring remains the same as previously described in all methods of play. A third method available for player selection is the player making the "tag" is allowed to move his marker away from the "it" marker two squars of any color in any direction. It is to be noted that more than one player may occupy the same square. If the "it" marker lands adjacent to a square occupied by more than one player, the "it"-player is allowed to select the player's marker he wishes to "tag" and that player's marker becomes "it." If another player's marker is on the same square with a "tagged" marker, the other player or players are allowed an escape movement of two squares.

Each player must move his marker to the adjacent colored square on the same field that matches the color of each card as he turns his color side up. He must play his selected color even if picked in error. If a player's marker is on the edge of the playing field and a color he has picked is not adjacently available, his marker cannot be moved. A sequence of a game turn includes (1) each player select two cards from his assigned deck of nine and lays them face down in front of him, (2) each player turns over one card and moves his marker to the adjacent square matching the color of the card, (3) each player turned over the second card and again moves his marker to the adjacent square which matches the card color, (4) the player who is "it" would move any free squares due to matches made, (5) any tags would be made if any tags were to be made, (6) one of the three restart methods would be selected and used, and (7) the "it" player would mark up a point on his scoring strip and that would constitute the end of a game turn.

Although I have described my invention with considerable details in the specification and in the game description, a part thereof, it is to be understood that certain modifications in parts and structure and the use thereof may be parcticed which do not exceed the intent of the scope of the appended claims.

What is claimed is:

1. A board game with cooperative parts and instructions for playing a game of "tag" comprising:

a game play board centrally hinged and foldable into two sections which when folded produce two outwardly faced section surfaces forming a cover side and two inwardly faced section surfaces together forming a game playing side; said game playing side having a matrix of colored squares each square being colored with one of nine different colors; said matrix of colored squares being divided into groups: each group comprises a matrix of nine squares; each of the nine squares in each of said groups being distinguishably colored wherein each group has nine differently colored squares; and bordering along all four edges of said field there being white colored scoring strips squared and numbered 1 to 15 useful for scoring by two to four players, said scoring strips each having a colored starting square preceding said numbered squares at said number 1; said starting squares being four in number and each starting square being distinguishably colored with one of said nine different colors to match two similarly colored markers supplied each player with one said marker being a player's position marker for use on said playing field and the other said marker being a player's scoring marker for use on said scoring strip; said supplied markers being eight in number and moved according to supplied instructions; a plurality of colored playing cards drawn from four nine-card decks, one deck supplied to each said player; said nine cards in each player's deck each having a face side colored to correspond to one of said nine different colors, wherein said nine different colors are represented on each deck.

* * * * *